US007985311B2

(12) United States Patent
Guindon et al.

(10) Patent No.: US 7,985,311 B2
(45) Date of Patent: Jul. 26, 2011

(54) NON-TOXIC HEAVY-METAL FREE-ZINC PEROXIDE-CONTAINING IR TRACER COMPOSITIONS AND IR TRACER PROJECTILES CONTAINING SAME FOR GENERATING A DIM VISIBILITY IR TRACE

(75) Inventors: Louise Guindon, Ville de Laval (CA); Carol Jalbert, Lachenaie (CA); Daniel Lepage, Le Gardeur (CA)

(73) Assignee: General Dynamics Ordnance and Tactical Systems - Canada Inc., Le Gardeur, Quebec (CA)

( * ) Notice: Subject to any disclaimer, the term of this patent is extended or adjusted under 35 U.S.C. 154(b) by 122 days.

(21) Appl. No.: 11/910,654

(22) PCT Filed: Mar. 28, 2007

(86) PCT No.: PCT/CA2006/000455

§ 371 (c)(1),
(2), (4) Date: Jun. 7, 2008

(87) PCT Pub. No.: WO2006/105635

PCT Pub. Date: Oct. 12, 2006

(65) Prior Publication Data

US 2008/0307995 A1 Dec. 18, 2008

Related U.S. Application Data

(63) Continuation-in-part of application No. 11/098,368, filed on Apr. 5, 2005, now abandoned.

(51) Int. Cl.

| | |
|---|---|
| ***C06B 25/20*** | (2006.01) |
| ***D03D 23/00*** | (2006.01) |
| ***D03D 43/00*** | (2006.01) |

(52) U.S. Cl. ..... 149/100; 149/109.2; 149/109.4

(58) Field of Classification Search ..... 149/100, 149/109.2, 109.4

See application file for complete search history.

(56) References Cited

U.S. PATENT DOCUMENTS

| | | | | |
|---|---|---|---|---|
| 1,708,187 | A * | 4/1929 | Meek | 149/41 |
| 1,925,641 | A * | 9/1933 | Lucas | 149/37 |
| 2,988,438 | A | 6/1961 | Allovio | |
| 3,677,842 | A | 7/1972 | Doris, Jr. | |
| 4,128,443 | A * | 12/1978 | Pawlak et al. | 149/71 |
| 4,363,679 | A | 12/1982 | Hagel et al. | |
| 4,597,810 | A | 7/1986 | Trickel et al. | |
| 5,472,536 | A | 12/1995 | Doris et al. | |
| 5,639,984 | A * | 6/1997 | Nielson | 102/336 |
| 5,811,724 | A * | 9/1998 | Henry et al. | 149/18 |
| 6,228,191 | B1 | 5/2001 | Leenders | |
| 6,969,433 | B1 | 11/2005 | Bley et al. | |

* cited by examiner

*Primary Examiner* — James E McDonough

(74) *Attorney, Agent, or Firm* — Sheema Khan; Miltons IP/p.i.

(57) ABSTRACT

Novel non-toxic, heavy-metal free, zinc peroxide-containing, IR tracer compositions are provided herein, which, when incorporated into a medium caliber IR tracer projectile and fired, produce a dim visibility IR trace. Such IR tracer compositions comprise from about 65 to about 75% by weight, of zinc peroxide; from about 15 to about 25% by weight of a fuel which consists of sodium salicylate; and an effective amount of a binder which is selected from the group consisting of calcium resinate and cellulose acetate butyrate. The total percentage of the ingredients adds up to 100%. Medium caliber, i.e., 0.50 caliber, IR tracer projectiles containing such IR tracer compositions are also provided.

7 Claims, 1 Drawing Sheet

NON-TOXIC HEAVY-METAL FREE-ZINC PEROXIDE-CONTAINING IR TRACER COMPOSITIONS AND IR TRACER PROJECTILES CONTAINING SAME FOR GENERATING A DIM VISIBILITY IR TRACE

This application is a continuation-in-part of U.S. patent application Ser. No. 11/098,368 filed Apr. 5, 2005.

FIELD OF THE INVENTION

This invention relates to non-toxic, zinc peroxide-containing, IR tracer compositions and to IR tracer projectiles containing such compositions which, when fired, generate a dim visibility IR trace.

BACKGROUND OF THE INVENTION

The art is replete with patents which are directed to tracer compositions, incendiary compositions and pyrotechnic compositions. Among such prior art patents are the following:

U.S. Pat. No. 5,811,724, patented Sep. 22, 1998, INFRA-RED TRACER FOR AMMUNITION and assigned to Primex Technologies Inc. Those patented composition included both strontium and barium. However, such IR tracer compositions suffer from the defect that barium is a toxic element.

U.S. Pat. No. 5,661,257, patented Aug. 26, 1997, MULTI-SPECTRAL COVERT TARGET MARKER. Such patented target marker included a near-IR emitting photodiode which was encased in a hardened polymeric molding material. Those patented target markers suffered from the defect that they were not easily amenable to be incorporated into an IR projectile.

U.S. Pat. No. 5,587,552, patented Dec. 24, 1996, INFRA-RED ILLUMINATING COMPOSITION, and assigned to Thiokol Corporation. Those patented compositions included cesium nitrate and rubidium nitrate as IR generators. However, those compositions suffered from the defects that such nitrates were uncommon, and hence that the compositions were not amenable to commercial production, and also that cesium and rubidium are believed to be toxic and suspected carcinogens.

U.S. Pat. No. 5,472,536, patented Dec. 5, 1995, TRACER MIXTURE FOR USE WITH LASER HARDENED OPTICS, and assigned to the US Secretary of the Army. Those patented compositions included magnesium as well as strontium nitrate, sodium nitrate and barium therein. However, such IR tracer compositions suffer from the defects that barium is a toxic element and that sodium emits yellow light.

U.S. Pat. No. 4,979,999, patented Dec. 18, 1990, TRACER COMPOSITION AND METHOD OF PRODUCING SAME, and assigned to The Minister of National Defence, Canada. Those patented compositions included magnesium and strontium nitrate. Thus, those patented composition suffered from the defect that magnesium emitted an excessive amount of visible light.

U.S. Pat. No. 4,597,810, patented Jul. 1, 1986, by N. E. Trickel, TRACER UNIT FOR AMMUNITION. Those patented compositions included magnesium and strontium. Thus, those patented composition suffered from the defect that toxic magnesium emitted an excessive amount of visible light.

U.S. Pat. No. 4,094,711, patented Jun. 13, 1978, TRACER AND COMPOSITION, and assigned to Ford Aerospace & Communications Corporation. Those patented composition included magnesium. Thus, those patented compositions suffered from the defect that they emitted visible light due to the presence of magnesium.

U.S. Pat. No. 2,899,291, patented Aug. 11, 1959, by R. H. Hieskell COMPOSITION FOR TRACER UNIT. Those patented compositions included magnesium, and barium and antimony sulfides. Thus, those patented compositions suffered from the defects that the presence of barium and antimony rendered the composition toxic and the presence of magnesium resulted in the emission of visible light.

U.S. Pat. No. 4,719,856, patented Jan. 19, 1988, PYROTECHNIC DEVICE, and assigned to Pains-Wessex Limited. Those patented compositions included titanium. Those patented compositions suffered from the defects that they generated excessive heat and also emitted visible light due to the presence of metallic titanium.

U.S. Pat. No. 3,983,816, patented Oct. 5, 1976, COMPOSITIONS FOR PRODUCING FLICKERING SIGNALS and assigned to Thiokol Corporation. Those patented compositions included magnesium and/or aluminum, and barium nitrate or sodium nitrate. Such patented compositions suffered from the defects that they were toxic due to the presence of barium, emitted white light due to the presence of magnesium and/or aluminum and emitted yellow light due to the presence of sodium.

U.S. Pat. No. 4,881,464, patented Nov. 21, 1989, SIGNAL OR RESCUE FLARE OF VARIOUS LUMINOSITY, and assigned to the US Secretary of the Army. Such patented compositions included magnesium or aluminum. Those patented compositions suffered from the defect that they produced visible light due to the presence of magnesium or aluminum.

U.S. Pat. No. 3,986,907, patented Oct. 19, 1976, ILLUMINATING FLARE COMPOSITION CONTAINING TETRANITROCARBAZOLE, and assigned to Thiokol Corporation. Such patented compositions included magnesium granules. Those patented compositions suffered from the defect that they produced visible light due to the presence of magnesium granules.

U.S. Pat. No. 3,503,814, patented Mar. 31, 1970, PYROTECHNIC DEVICE CONTAINING NICKEL AND ALUMINUM and assigned to the US Secretary of the Navy.

Such patented compositions contained magnesium as well as bismuth oxide. Those patented compositions suffered from the defects that they generated excessive heat, produced visible light due to the presence of magnesium.

SUMMARY OF THE INVENTION

Aims of the Invention

Tracer projectiles provide a reliable means of determining whether projectiles impact on the desired target or whether adjustments in aim are necessary. One problem with the use of conventional tracer projectiles is that they emit visible light, which thereby makes the source of the tracer ammunition discernable to the enemy.

Accordingly it is an object of a first aspect of the present invention to provide improved IR tracer projectiles in which visible emissions are suppressed, whereby camouflage is optimized and an enemy cannot visually locate the source of the tracer projectile or the line of fire in order to direct a counter-attack toward that location.

An object of a second aspect of the present invention is to provide improved IR tracer projectiles which generate an IR trace which is substantially-completely IR radiation.

It is an object of a third aspect of the present invention to provide improved IR tracer projectiles which generate an IR trace which is substantially-completely IR radiation, and which has an appropriate burning rate so that it can be observed by the users at a longer distance down range.

It is an object of a fourth aspect of the present invention to provide improved IR tracer projectiles which generate an IR trace which is substantially-completely IR radiation, and which has a lower energetic output to minimize the risk of fire propagation in bushes and wooded areas where the projectile lands.

It is an object of a fifth aspect of the present invention to provide improved IR tracer projectiles which generate an IR trace which is substantially-completely IR radiation, and which has a controlled IR emission at any particular point to avoid very high intensity visible light emissions which could temporarily blind an observer using an infrared detection system.

It is an object of a sixth aspect of the present invention to provide improved IR tracer compositions which have a uniform granularity to facilitate the controlled production of the IR tracer projectiles which generate an IR trace which is substantially-completely IR radiation.

It is an object of a seventh aspect of the present invention to provide improved IR tracer compositions which do not significantly degrade with time under extreme environmental conditions when stored at about 5 to 20° C., and thus which provides IR tracer projectiles which generate an IR trace which is substantially-completely IR radiation.

It is an object of an eighth aspect of the present invention to provide improved IR tracer compositions which do not contain heavy metals, e.g., barium nor any other toxic elements, and which is combined with a non-toxic igniter composition, to provide environmentally-friendly IR tracer compositions which are non-toxic, to provide IR tracer projectiles which generate an IR trace which is substantially-completely IR radiation.

It is an object of a ninth aspect of the present invention to provide improved IR tracer compositions which are formulated using a selected solvent for mixing the ingredients, in order to facilitate the manufacturing process by providing the IR tracer composition with uniform granularity and improved flowability so that the IR tracer charge weight compressed into IR tracer projectiles which generate an IR trace which is substantially-completely IR radiation, could be better controlled.

Statements of Invention

A broad aspect of the present invention provides a non-toxic substantially heavy-metal-free, zinc peroxide-containing, IR tracer composition comprising: from about 26 to about 30% by weight, or from about 65 to about 80% by weight, of zinc peroxide; from about 40 to about 47% by weight of potassium nitrate; from about 10 to about 25% by weight of a fuel which consists of sodium salicylate; from about 5 to about 26% by weight of a retardant which consists of either iron carbonate or magnesium carbonate or calcium carbonate; from about 5 to about 10% by weight of at least one binder which is either calcium resinate, or a synthetic resin binder which consists of a copolymer of hexafluoropropylene and vinylidene fluoride, or from about 5 to about 7.5% by weight of cellulose acetate butyrate; wherein the total percentage of the ingredients add up to 100%.

Other embodiments and aspects of the invention comprise the following substantially-heavy-metal-free, zinc peroxide-containing, IR tracer compositions:

From about 26 to about 30% by weight zinc peroxide; from about 40 to about 45% by weight of potassium nitrate; from about 20 to about 25% by weight of iron carbonate; and from about 5 to about 7.5% by weight of cellulose acetate butyrate; wherein the total percentage of the ingredients add up to 100%;

About 30% by weight zinc peroxide; about 42.5% by weight of potassium nitrate; about 20% by weight of iron carbonate; and about 7.5% by weight of cellulose acetate butyrate, wherein the total percentage of the ingredients add up to 100%;

From about 65 to about 70% by weight of zinc peroxide; from about 20 to about 25% by weight of sodium salicylate; and from about 8 to about 10% by weight of calcium resinate, wherein the total percentage of the ingredients add up to 100%;

About 65% by weight of zinc peroxide; about 25% by weight of sodium salicylate; and about 10% by weight of calcium resinate; wherein the total percentage of the ingredients add up to 100%;

From about 26 to about 28% by weight of zinc peroxide; from about 40 to about 45% by weight of potassium nitrate; from about 22 to about 26% by weight of iron carbonate; and from about 5 to about 7.5% by weight of cellulose acetate butyrate; wherein the total percentage of the ingredients add up to 100%;

About 26% by weight of zinc peroxide; about 42.5% by weight of potassium nitrate; about 24% by weight of iron carbonate; and about 7.5% by weight of cellulose acetate butyrate, wherein the total percentage of the ingredients add up to 100%;

From about 26 to about 30% by weight of zinc peroxide; from about 42 to about 47% by weight of potassium nitrate; from about 15 to about 25% by weight of iron carbonate; and from about 5 to about 7.5% by weight of cellulose acetate butyrate; wherein the total percentage of the ingredients add up to 100%;

About 28% by weight of zinc peroxide; about 44.5% by weight of potassium nitrate; about 20% by weight of iron carbonate; and about 7.5% by weight of cellulose acetate butyrate; wherein the total percentage of the ingredients add up to 100%;

From about 26 to about 30% by weight of zinc peroxide; from about 40 to about 45% by weight of potassium nitrate; from about 15 to about 25% by weight of iron carbonate; and from about 5 to about 7.5% by weight of cellulose acetate butyrate; wherein the total percentage of the ingredients add up to 100%;

About 28% by weight of zinc peroxide; about 44.5% by weight of potassium nitrate; about 20% by weight of iron carbonate; and about 7.5% by weight of cellulose acetate butyrate; wherein the total percentage of the ingredients add up to 100%;

From about 26 to about 30% by weight of zinc peroxide; from about 42 to about 47% by weight of potassium nitrate; from about 15 to about 25% by weight of magnesium carbonate; and from about 5 to about 7.5% by weight of cellulose acetate butyrate; wherein the total percentage of the ingredients add up to 100%;

About 28% by weight of zinc peroxide; about 44.5% by weight of potassium nitrate; about 20% by weight of magnesium carbonate; and about 7.5% by weight of cellulose acetate butyrate; wherein the total percentage of the ingredients add up to 100%;

From about 70 to about 80% by weight of zinc peroxide; from about 15 to about 20% by weight of sodium salicylate;

and from about 5 to about 10% by weight of calcium resinate; wherein the total percentage of the ingredients add up to 100%;

About 75% by weight of zinc peroxide; about 17.5% by weight of sodium salicylate; and about 7.5% by weight of calcium resinate; wherein the total percentage of the ingredients add up to 100%;

From about 70 to about 80% by weight of zinc peroxide; from about 10 to about 20% by weight of sodium salicylate; and from about 5 to about 12% by weight of calcium resinate; wherein the total percentage of the ingredients add up to 100%;

About 75% by weight of zinc peroxide; about 15% by weight of sodium salicylate; and about 10% by weight of calcium resinate; wherein the total percentage of the ingredients add up to 100%.

The present invention, in another aspect, provides an IR tracer projectile comprising a hollow cylindrical shell made of a suitable metallic material, and having a conical nose; a conventional heavy filler disposed in the hollow conical nose; the non-toxic, heavy-metal-free, zinc peroxide-containing, infrared tracer composition as disclosed hereinabove in its generic, sub-generic and specific aspects, compressed immediately against the filler; a conventional ignition material compressed against said compressed tracer composition; and a metal disc capping the hollow shell.

Generalized Description of the Invention

The present invention provides infrared-producing (hereinafter "IR"-producing) compositions which are capable of producing a consistent IR output when provided in IR tracer projectiles which are medium caliber, e.g., .50 caliber, long range accuracy ammunition (Match grade) The IR output includes near IR and far IR bands (0.76 to 3.0 μm). The intensity of the IR radiation depends on the specific wavelength of these bands.

Conventional pyrotechnic mixtures typically contain a finely-divided mixture of an oxidizer and a fuel (metallic, non-metallic or organic fuel). The oxidizer, which contains oxygen, is added to sustain combustion and the metallic atoms are responsible for the characteristic color output. The fuel is added in order to sustain combustion of the mixture and to provide heat energy.

Finely divided powdered fuel is very reactive with an oxidizing agent. Above a certain temperature, namely, the ignition temperature, the oxidizer decomposes to release oxygen, which then reacts quickly with the fuel in an exothermic reaction. An oxidizer and a fuel alone, however, do not make practical compositions for the purpose of providing suitable emissions. Each of a flame retardant and a binding agent is also incorporated into the mixture.

The IR tracer compositions of aspects of the present invention possess unique requirements not generally addressed by the prior art conventional tracer systems. While it is not desired to be limited to any particular theory, it is believed that a hypothesis concerning the formation of purely infrared emission without the presence of visible light may be developed based on black body radiation theory. The requirement would then be for the IR tracer to maximize output at a wavelength of 1 to 3 μm range.

The desired IR range is significantly below the flame temperature of present conventional tracer and flame formulations. This knowledge, coupled with the understanding that visible light output is normally the smallest proportion of energy radiation during combustion, leads to the conclusion that an effective IR tracer according to aspects of the present invention is based on a relatively cool burning tracer formulation.

Various chemical compositions were investigated to maximize the IR intensity while also maximizing the duration of the IR trace and minimizing the generation of excessive amounts of heat for each type of medium caliber projectiles. The compositions to be described hereinafter burn cleanly and relatively coolly and emit relatively-small (i.e., almost negligible) quantities of visible light in proportion to the infrared radiation emitted.

The basic components of the IR tracer compositions of aspects of the present invention are able to augment near-IR emissions when fired. This is accomplished by the addition of an IR producing oxidizer and fuel. Thus, the IR tracer compositions of aspects of the present invention include zinc peroxide as the oxidizer, an organic fuel, a flame retardant, and a binder.

As noted above, the oxidizer is zinc peroxide. Peroxides of other transition metals, e.g., titanium, chromium, manganese, iron, cobalt, nickel, copper, zirconium, etc, are not useful in the IR tracer composition of aspects of the invention. The peroxides of such transition metals either provide inert compositions or provide compositions which emit toxic effluents.

The preferred organic fuel is sodium salicylate ($C_7H_5NaO_3$). This organic fuel has a low melting point and generates a large amount of gases during the combustion, which facilitates the removal of solid residues and soot inside the tracer cavity of the projectile. Without obstruction, the trace can be seen at a longer distances down range. Neither lithium salicylate nor potassium salicylate would be suitable since they provide compositions which are too hygroscopic. Furthermore, these compounds are not conveniently commercially available and so the compositions cannot be easily industrialized.

Another component of the IR tracer compositions of aspects of the present invention is potassium nitrate. The nitrates of other alkali metals are not useful in IR tracer compositions of aspects of the present invention, since lithium nitrate produces a composition which is too hygroscopic, while sodium nitrate emits a yellow color.

The preferred flame retardants in the IR tracer compositions of aspects of the present invention are iron carbonate and magnesium carbonate although calcium carbonate would also be useful. The presence of iron carbonate or magnesium carbonate or calcium carbonate brings about a better control of the rate of burning and reduces substantially the flash and output of visible light. The carbonates of other transition metals are not suitable. For example, the carbonates of chromium and cobalt contaminate the atmosphere, the carbonate of nickel has carcinogenic properties and the carbonate of zirconium has excessive luminosity properties.

A binder maintains the other particulate forms of constituents of the IR tracer compositions of aspects of the present invention together. The binder increases the structural integrity of the IR tracer composition to prevent any break up of the trace in flight. It protects the composition from moisture and increases the flowability of the composition. Suitable binders include cellulose acetate butyrate (CAB), calcium resinate, a vinyl acetate resin or the fluoroelastomer known by the trade mark VITON A. Such binders have the properties of acting as a fuel retardant, as a waterproofing agent, and/or as an agent to reduce soot formation.

The IR tracer compositions of aspects of the present invention differ significantly over conventional tracer compositions, especially conventional IR tracer compositions, of the prior art in the absence of boron.

BRIEF DESCRIPTION OF THE DRAWING

Embodiments of the present invention will be described, by way of example only, with reference also to the attached FIGURE which is a one-half longitudinal cross-section of a tracer projectile according to one embodiment of the present invention.

EXAMPLES

Preparation of IR Tracer Compositions

Figure 1:
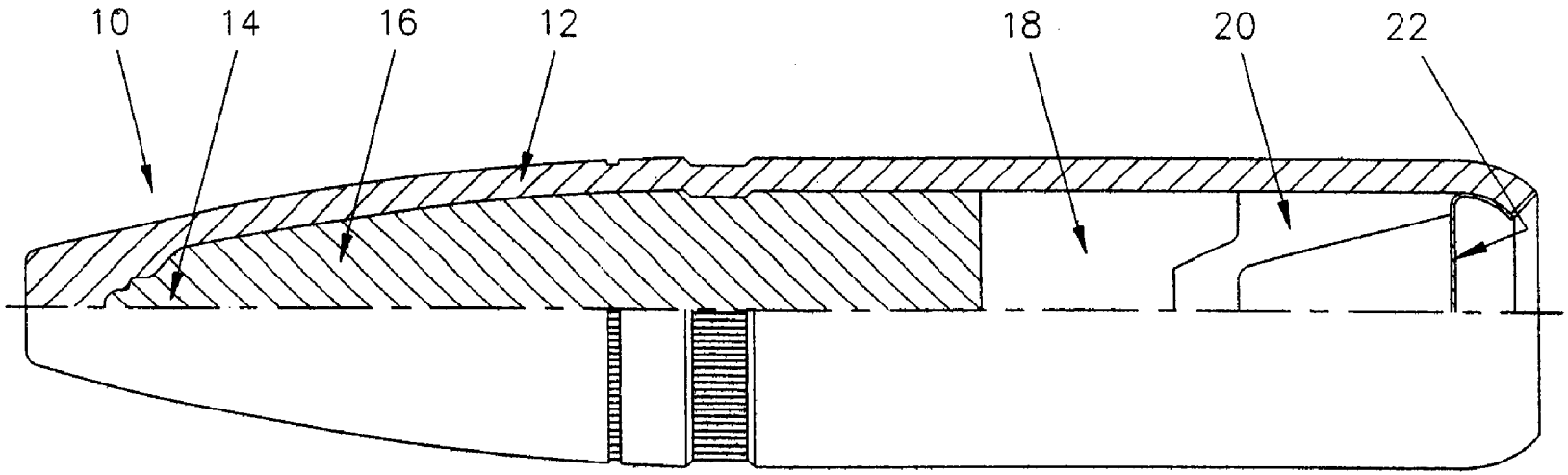

The IR tracer compositions were prepared by first dry mixing the powdered ingredients to provide a dry intermediate composition. The binder was dissolved in a suitable aprotic solvent, namely, methyl ethyl ketone. The so-formed binder solution was then incorporated into the dry intermediate composition to provide a wet mixture. The wet mixture so provided was transferred to a suitable mixer in order to obtain a substantially-completely homogeneous mixture of all ingredients. The homogenous mixture so-formed was dried in an oven at about 20-40° C. until it was sufficiently dry for sieving. The dry mixture was then sieved to break up agglomerated particles. The IR tracer composition was thus provided as relatively small particles of random shape.

A series of IR tracer compositions according to aspects of the present invention was prepared according to the proportion of ingredients as set forth in the following Tables 1A and 1B.

TABLE 1A

| | PERCENTAGE IN TEST NO TEST NO | | | | |
|---|---|---|---|---|---|
| INGREDIENT | DT-48 | DT-49 | DT-50 | DT-51 | DT-52 |
| ZINC PEROXIDE | 30 | 28 | 26 | 28 | 28 |
| POTASSIUM NITRATE | 42.5 | 42.5 | 42.5 | 44.5 | 44.5 |
| IRON CARBONATE | 20 | 22 | 24 | 20 | 0 |
| CAB | 7.5 | 7.5 | 7.7 | 7.5 | 7.5 |
| MAGNESIUM CARBONATE | 0 | 0 | 0 | 0 | 20 |

TABLE 1B

| | PERCENTAGE IN TEST NO TEST NO | | | |
|---|---|---|---|---|
| INGREDIENT | DT-53 | DT-54 | DT-55 | DT-56 |
| ZINC PEROXIDE | 28 | 65 | 75 | 75 |
| SODIUM SALICYLATE | 44.5 | 25 | 17.5 | 10 |
| CALCIUM RESINATE | 20 | 10 | 7.5 | 10 |
| CAB | 7.5 | | | |

Preparation of Test Projectiles

Each of the above IR tracer compositions of aspects of the present invention was compressed into a projectile body of a desired medium caliber. For the tests which are to be described below, the caliber of the projectile body was .50 caliber. Thus, as seen in the drawing, the tracer projectile 10 includes a hollow shell 12 of, preferably, a copper alloy (90% Cu/10% Zn), whose hollow nose 14 is filled with a suitable heavy filler 16. The IR tracer composition 18 is compressed immediately against the filler 16. A conventional ignition material 20 is compressed against the IR tracer composition 18. The IR tracer projectile 10 is capped by means of a brass closure disc 22.

Test Procedures

For these series of tests, each of the IR tracer compositions was inserted into .50 caliber tracer projectiles and fired. When such IR tracer projectile was fired, the IR tracer composition inside the projectile body was ignited by hot gases emitted by a propellant.

Several important criteria for the IR trace, namely its stability, its intensity, whether any visible light was detected and if a spark occurred at the firing point were evaluated as follows:

Three observers were stationed, one each, at the point of firing, at 250 m down range and at 400 m down range. These observers noted each of the above criteria.

The visibility with night vision goggles was determined by the same observers at the same three positions The distinctness of the trace was noted at a barrier located 1000 m down range. NATO criteria is distinctness at 600 m down range The visibility with the naked eye of the tracer projectile was determined by the same observers at the firing position along the trajectory path and perpendicular to the trajectory path at 200 m down range and at 400 m down range from the firing position.

The calorific output of the tracer projectile was measured with a calorimeter.

The results are summarized as follows:

The IR trace was found to be visible from the firing position and could not be seen with the naked eye by the observers placed at an angle with respect to the trajectory of the IR tracer projectile.

The calorific output of the IR tracer composition measured with a calorimeter was about 500 cal/g, which is about one third less than the calorific output generated by conventional IR tracer compositions, (500 cal/g compared to 1200 cal/g for conventional IR tracer compositions). The IR trace can, thus, be designated as a cold trace.

The IR intensity of the IR emission as measured with a spectrophotometer equipped with IR filters at a wavelength of 760 nanometers was found to be about 1 to 4 watts/steradian, and at a wavelength of 3,000 nanometers was found to be about 1.7 to 2.1 watts/steradian. The IR tracer compositions of aspects of the present invention was found to have an IR luminosity as measured with a spectrophotometer at a wavelength of 760 nanometers of about 1 to 2 watts/steradian and an IR luminosity as measured with a spectrophotometer at a wavelength of 3000 nanometers of about 1 to 4 watts/steradian.

For medium caliber, i.e., .50 caliber, IR tracer projectiles, the IR trace can be seen up to 1000 m compared to 600 m for conventional .50 caliber tracer projectiles.

The medium caliber, i.e., .50 caliber, IR tracer projectiles of an aspect of the present invention containing the IR tracer compositions of aspects of the present invention have been found to increase the length of trace along the firing line by up to about 120%.

It has been found that the IR tracer compositions of aspects of the present invention produce relatively low burn rate materials so that the IR trace can be seen from the firing point to a longer distance down range. The burn rate is adjustable for medium caliber, i.e., .50 caliber, ammunition to meet or exceed NATO and specific user requirements. Thus, particular burn rates can be adjusted, the ratio of IR radiation to visible light can be optimized (i.e., substantially no visible light), and the general physical and chemical properties can be carefully selected.

The medium caliber i.e., .50 caliber, IR tracer projectiles of aspects of the present invention containing the IR tracer compositions of aspects of the present invention have a relatively slow burning rate so that the IR tracer can be seen up to 1800 m compared to 1500 m for conventional .50 caliber tracer projectiles.

The IR tracer compositions of aspects of the present invention do not degrade with time, when properly stored at a temperature varying between 5° C. and 20° C., with a relative humidity which ranged between 50% and 70%. For example, the calorific heat of an IR tracer projectile containing IR tracer compositions of aspects of the present invention at the beginning of the storage period was about 675 cal/g and remained constant over a minimum storage period of 6 months.

The IR tracer compositions of aspects of the present invention do not contain any toxic elements The IR tracer compositions of aspects of the present invention may easily be industrialized.

Not all zinc peroxide-containing compositions satisfy the utility requirements as set forth in the above tests. Thus, compositions having the ingredients/proportions set forth in the following Tables 2A, 2B and 2C have been found not to be useful

TABLE 2A

| | PERCENTAGE IN TEST NO TEST NO | | | | | |
|---|---|---|---|---|---|---|
| INGREDIENT | DT-02 | DT-05 | DT-13 | DT-19 | DT-20 | DT-31 |
| ZINC PEROXIDE | 40 | 50 | 50 | 34 | 49 | 48 |
| POTASSIUM CHLORATE | 0 | 0 | 0 | 9 | 5 | 0 |
| MAGNESIUM CARBONATE | 10 | 10 | 10 | 0 | 0 | 0 |
| POLYISOBUTYLENE | 0 | 5 | 5 | 0 | 0 | 0 |
| CALCIUM RESINATE | 10 | 0 | 0 | 0 | 0 | 0 |
| STRONTIUM OXIDE | 40 | 0 | 0 | 0 | 0 | 0 |
| POTASSIUM NITRATE | 0 | 25 | 25 | 0 | 24.5 | 24.5 |
| METALLIC IRON | 0 | 10 | 0 | 0 | 0 | 0 |
| SILICON | 0 | 0 | 10 | 0 | 0 | 0 |
| BARIUM CHROMATE | 0 | 0 | 0 | 52 | 41 | 0 |
| SILICON DIOXIDE | 0 | 0 | 0 | 5 | 0 | 0 |
| IRON CARBONATE | 0 | 0 | 0 | 0 | 20 | 20 |
| CAB | 0 | 0 | 0 | 0 | 0 | 7.5 |

TABLE 2B

| | PERCENTAGE IN TEST NO. TEST NO | | | | |
|---|---|---|---|---|---|
| INGREDIENT | DT-32 | DT-33 | DT-34 | DT-35 | DT-36 |
| ZINC PEROXIDE | 48 | 48 | 50 | 40 | 40 |
| POTASSIUM NITRATE | 24.5 | 24.5 | 26.5 | 40 | 40 |
| IRON CARBONATE | 20 | 20 | 20 | 10 | 10 |
| CAB | 0 | 0 | 0 | 0 | 10 |
| CALCIUM RESINATE | 10 | 7.5 | | 10 | |
| METALLIC IRON | 0 | 0 | 0 | 0 | 0 |
| VITON A | 7.5 | 0 | 0 | 0 | 0 |
| TEFLON | 0 | 0 | 1.5 | 0 | 0 |
| NC | 0 | 0 | 2 | 0 | 0 |

TABLE 2C

| | PERCENTAGE IN TEST NO TEST NO | | | | | |
|---|---|---|---|---|---|---|
| INGREDIENT | DT-40 | DT-41 | DT-42 | DT-43 | DT-44 | DT-45 |
| ZINC PEROXIDE | 41 | 32.5 | 37.75 | 34.75 | 46.25 | 50.75 |
| POTASSIUM NITRATE | 41 | 50.75 | 36.25 | 34.75 | 27.75 | 32.5 |
| IRON CARBONATE | 10.5 | 9.25 | 18.5 | 23 | 18.5 | 9.25 |
| CAB | 7.5 | 7.5 | 7.5 | 7.5 | 7.5 | 7.5 |

SUMMARY

In summary, the present invention provides IR tracer compositions for the production of IR projectiles for medium caliber, i.e., .50 caliber, ammunition. The IR tracer compositions of aspects of the present invention are non-toxic. When incorporated into medium caliber, i.e., .50 caliber, IR tracer projectiles and fired, they have a lower calorific output than conventional compositions and they produce a cool IR trace which is not visible to the naked eye, i.e., it is a dim trace. The rate of burning is selectively controllable so that the IR trace can be seen at longer distance from the firing position than conventional IR trace projectiles containing conventional IR trace compositions.

The above-described embodiments of aspects of the invention are intended to be examples of the present invention. Alterations, modifications and variations may be effected to the particular embodiments by those of ordinary skill in the art, without departing from the spirit and scope of the invention, which is defined solely by the claims appended hereto

The invention claimed is:

1. A non-toxic, substantially-heavy-metal-free, zinc peroxide-containing infrared tracer composition having a maximum IR output at a wavelength range of between 1 to 3 μm comprising: from about 65 to about 75% by weight of zinc peroxide; from about 15 to about 25% by weight of a fuel which consists of sodium salicylate; and an effective amount of a binder which is selected from the group consisting of calcium resinate and cellulose acetate butyrate; with the proviso that the infrared tracer composition excludes a burn rate catalyst; and wherein the total percentage of all said ingredients add up to 100%.

2. The composition as claimed in claim 1, comprising about 7 to about 10% by weight of calcium resinate.

3. The composition as claimed in claim 1, comprising: from about 65 to about 70% by weight of zinc peroxide; from about 20 to about 25% by weight of sodium salicylate; and from about 8 to about 10% by weight of calcium resinate.

4. The composition as claimed in claim 3, comprising: about 65% by weight of zinc peroxide; about 25% by weight of sodium salicylate; and about 10% by weight of calcium resinate.

5. The composition as claimed in claim 1, comprising: from about 65 to about 75% by weight of zinc peroxide; from about 15 to about 20% by weight of sodium salicylate; and from about 7.5 to about 10% by weight of calcium resinate.

6. The composition as claimed in claim 5, comprising: about 75% by weight of zinc peroxide; about 17.5% by weight of sodium salicylate; and about 7.5% by weight of calcium resinate.

7. The composition as claimed in claim 5, comprising: about 75% by weight of zinc peroxide; about 15% by weight of sodium salicylate; and about 10% by weight of calcium resinate.

* * * * *